US008978765B2

(12) United States Patent
Braekke et al.

(10) Patent No.: US 8,978,765 B2
(45) Date of Patent: Mar. 17, 2015

(54) SYSTEM AND METHOD FOR OPERATING MULTIPLE VALVES

(75) Inventors: Kristoffer Braekke, Stavanger (NO); Geir Lunde, Sandnes (NO); Roger Antonsen, Randaberg (NO)

(73) Assignee: I-Tec AS, Stavanger (NO)

( * ) Notice: Subject to any disclaimer, the term of this patent is extended or adjusted under 35 U.S.C. 154(b) by 0 days.

(21) Appl. No.: 13/316,317

(22) Filed: Dec. 9, 2011

(65) Prior Publication Data

US 2012/0160515 A1 Jun. 28, 2012

Related U.S. Application Data

(63) Continuation-in-part of application No. 12/976,727, filed on Dec. 22, 2010.

(30) Foreign Application Priority Data

Dec. 13, 2010 (NO) ..... 20101748

(51) Int. Cl.
*E21B 34/14* (2006.01)

(52) U.S. Cl.
CPC ..... *E21B 34/14* (2013.01)
USPC ..... 166/334.4; 166/376

(58) Field of Classification Search
USPC ..... 166/308.1, 313, 318, 334.4, 376
See application file for complete search history.

(56) References Cited

U.S. PATENT DOCUMENTS

| | | | | |
|---|---|---|---|---|
| 3,868,061 | A * | 2/1975 | Hehl | 239/571 |
| 4,270,569 | A * | 6/1981 | Reay et al. | 137/514.7 |
| 4,360,063 | A | 11/1982 | Kilgore | |
| 5,048,611 | A | 9/1991 | Cochran | |
| 6,253,861 | B1 | 7/2001 | Carmichael et al. | |
| 6,634,428 | B2 | 10/2003 | Krauss et al. | |
| 2004/0035591 | A1 * | 2/2004 | Echols | 166/386 |
| 2006/0124310 | A1 * | 6/2006 | Lopez de Cardenas et al. | 166/313 |
| 2007/0151734 | A1 | 7/2007 | Fehr et al. | |
| 2008/0179060 | A1 | 7/2008 | Surjaatmadja et al. | |
| 2009/0308588 | A1 | 12/2009 | Howell et al. | |
| 2010/0122817 | A1 | 5/2010 | Surjaatmadja et al. | |
| 2011/0192607 | A1 * | 8/2011 | Hofman et al. | 166/317 |

FOREIGN PATENT DOCUMENTS

| | | | |
|---|---|---|---|
| CA | 2628778 | A1 | 6/2006 |
| NO | 324012 | | 11/2002 |
| WO | WO-2010/127457 | A1 | 11/2010 |

OTHER PUBLICATIONS

Extended European Search Report for Application No. EP11192992, dated Feb. 17, 2012.

(Continued)

*Primary Examiner* — David Andrews
*Assistant Examiner* — Kristyn Hall
(74) *Attorney, Agent, or Firm* — Marshall, Gerstein & Borun LLP

(57) ABSTRACT

A valve system for providing fluid flow through radial openings disposed along an axial length of a tubular. The tubular comprises at least one valve group containing at least two valves operable by one drop ball. An inset 302 e.g. of standard grade steel provided in a harder liner 301 in the opening provides an intermediate small opening for at least the time required to open all the remaining valves in the group. The small opening limits the pressure drop over the valve. When all valves are open, the insets 302 are eroded away by an abrasive material, e.g. a slurry used for hydraulic fracturing, and permanent full openings are created.

14 Claims, 4 Drawing Sheets

(56) References Cited

OTHER PUBLICATIONS

Search Report for Norwegian Application No. 20111679, dated Jul. 2, 2012.

Office Action for Norwegian Patent Application No. 20101748, dated Dec. 13, 2010.

* cited by examiner

SYSTEM AND METHOD FOR OPERATING MULTIPLE VALVES

CROSS-REFERENCE TO RELATED APPLICATIONS

This is a continuation-in-part of U.S. application Ser. No. 12/976,727 filed Dec. 22, 2010, which claims the priority benefit under USC 119 of NO 20101748 filed Dec. 13, 2010, and NO 20111679 filed Dec. 9, 2011, the entire respective disclosures of which are incorporated herein by reference.

BACKGROUND OF THE INVENTION

1. Field of the Invention

The present invention relates to a valve system and method for providing fluid flow between the interior and exterior of a tubular through several radial openings disposed along an axial length of the tubular. It allows opening multiple valves by one drop ball, and it may find applications in recovery of hydrocarbons from subterranean formations.

2. Prior and Related Art

A subterranean formation containing hydrocarbons consists of at least one layer of soft or fractured rock to contain the hydrocarbons, in the following called a production layer. Each production layer must be covered by a layer of impermeable rock preventing the hydrocarbons from escaping. The production layers in an oil or gas field are collectively known as the reservoir. A production well extending through the reservoir is conventionally divided into production zones, one or more production zones per production layer. A production well may extend several thousand meters vertically through the formation, and be connected to horizontal branches extending up to several kilometers through a production layer. One or more injection wells may be provided at a distance from the production well(s) in a field. The injection wells can be used to pump water, brine or gas into the formation in order to increase the pressure. Additives such as acid, solvents or surfactants may be added to the fluid in order to enhance production of hydrocarbons in processes known as "stimulating a zone".

The production and injection wells and horizontal branches are typically lined with a steel pipe cemented to the formation and penetrated at the production layer(s). As known in the art, this pipe consists of sections having a decreasing diameter as the distance from the surface increases. In this disclosure, no distinction is made between a liner and a casing. That is, all steel pipes lining a borehole are denoted "casing" in the following. A smaller diameter production pipe or riser is provided within the casing of a production well, and used for conveying formation fluid typically consisting of a mixture of oil, water and gas, to the surface. Steel pipes of different diameters used for casing, production pipes or risers are collectively known as tubulars.

Production zones may be separated by packers sealing the annulus formed by the outer surface of a production pipe and the inner surface of a casing. The annulus formed by the borehole walls and outer circumference of a casing is usually sealed by cement and sometimes by open hole packers.

Hydraulic fracturing is a technique to enhance the flow of fluid from the formation, where the hydraulic pressure in a production zone is increased until fractures or cracks in the formation are enlarged. A slurry containing fracturing material, e.g. sand, ceramic balls or similar particles, is pumped into the cracks. When the fracturing pressure is removed, the fracturing material remains in the cracks, keeping them open. For the present invention, it is noted that the slurry containing fracturing material, e.g. sand, ceramic balls or similar particles, used for hydraulic fracturing is highly abrasive, especially where the flow of slurry changes direction from an axial direction through a pipe to a radial movement through openings in a valve. Hence, the radial openings of a valve used for hydraulic fracturing may be lined with a hard material, e.g. tungsten carbide (WC). It is further noted that pumps and other equipment for handling the abrasive slurry and pressures involved in hydraulic fracturing are readily available.

Valves are used to control the flow of formation fluid from a production zone into the production pipe through the casing, possibly through a horizontal branch. Valves are also used for controlling an injection fluid from an injection well into a zone of the formation to be stimulated. When the formation fluid from a production zone contains too much water to be economically sustainable, the production zone is shut down, typically by means of one or more valves. The valves are operated between open and closed, and possibly choked, positions using a variety if techniques, including the use of wireline tools, strings of pipes, coiled tubing, self-propagating tools known as well tractors, and drop balls. Some valves may be operated using separate hydraulic control lines. However, the space and cost required for providing separate hydraulic control lines and relatively expensive hydraulic valves quickly make hydraulically operated valves impractical for use in a tubular with many valves. This is especially true if the valves are to be opened once, and then left open.

A drop ball may be dropped or pumped into a tubular. Once it lands on a seat of a device, it prevents further fluid flow through the tubular, and hydraulic pressure builds up behind it. This hydraulic pressure may be used to operate the device, e.g. to open a valve. Thus, a drop ball may provide a simple, inexpensive and convenient way to open a valve. It does not require expensive equipment like a string of pipes, coiled tubing or a well tractor, and it can be delivered to a device in less time than it takes to make up a string, insert coiled tubing or for a well tractor to crawl to the device. However, conventional drop ball systems uses one drop ball per device, such that a drop ball passes through all bigger seats in the system until it lands on the seat intended for it. To prevent a drop ball from getting stuck on a seat not intended for it, there is a certain minimum size difference in the drop balls of the system. Hence, the number of drop balls, and consequently the number of drop ball operated devices, has been limited to about 20 per system.

In a reservoir as the one discussed above, fluid, e.g. sea water or $CO_2$, may be pumped into a production layer from an injection well. The injected fluid ideally forces the hydrocarbons in front of it into a production pipe, e.g. a horizontal branch or a sealed off production zone of a production zone, and further through a riser to the surface. In reality, the flow of injected fluid will follow the easiest path to the nearest exit through a valve in a horizontal or vertical tubular, possibly leaving a substantial amount of desirable hydrocarbons in dead zones passed over by the easy path. Devices monitoring the formation fluid from this zone would correctly detect a break through of injected fluid. A break through of injected fluid may cause a decision to shut down the production zone, i.e. preventing more formation fluid flowing from the zone from entering the production pipe or riser, thus leaving valuable hydrocarbons in the dead zone in the formation permanently.

As discussed above, twenty or less ball operated valves would be possible along a length of tubular using a conventional drop ball system. As modern wellbores may extend more than 2000 meters vertically and/or horizontally, the average distance between ball operated valves would then exceed 100 meters, which could still constitute quite large dead zones.

U.S. patent application Ser. No. 12/705,428 "Expandable ball seat", which is assigned to i-Tec AS and herein incorporated by reference in its entirety, discloses a system for operating multiple devices using one drop ball. This system thus may permit the use of a larger number of ball operated valves in the various wellbores or tubulars as compared to conventional systems. However, unlike other ball operated devices in a well, a valve providing fluid flow between the formation and a central bore of a tubular reduces the hydraulic pressure in the bore once it opens and fluid starts flowing from the bore through radial openings to the formation. However, this hydraulic pressure is required to open the next valve, and the pressure drop must be compensated in order to open the next valve using a drop ball. When two valves are open, an even larger pressure drop must be compensated to open the third valve, etc. In a system designed for providing a good flow of formation fluids into a tubular, the valves should preferably have large radial openings, or nozzles, such that each valve tends to contribute a correspondingly large pressure drop as it is opened. This, in turn, may limit the number of valves operable by a drop ball in a tubular.

Hence, a main objective of the present invention is to provide a tubular with a large number of valves while avoiding expensive valves, hydraulic control lines and/or expensive production time spent for operating the valves by means of wireline tools, strings, well tractors, etc. A further objective is to handle the pressure drop associated with opening a valve, thereby reducing the hydraulic pressure available for opening the next valve by means of a drop ball.

SUMMARY OF THE INVENTION

This is achieved according to the present invention by providing a valve system for providing fluid flow through radial openings disposed along an axial length of a tubular, wherein at least one valve group comprises at least two valves operable by e.g. one drop ball, each valve having a closed state, an intermediate state providing an intermediate opening for at least the time required to open all the remaining valves in the valve group, and an open state providing a full radial opening larger than the intermediate opening.

In another aspect, the present invention provides a method for providing fluid flow through radial openings disposed along an axial length of a tubular, comprising the steps of: disposing at least one valve group associated with a section of the tubular, the valve group containing at least two valves operable by e.g. one drop ball in the tubular, each valve having a closed state, an intermediate state providing an intermediate opening for at least the time required to open all the remaining valves in the group, and an open state providing a full radial opening larger than the intermediate opening; altering the state of each valve from the closed state to the intermediate state in turn using the drop ball, and altering the state of each valve from the intermediate to the open state.

In a preferred embodiment, the intermediate state is provided by an inset made of standard steel having a small opening and set into a harder lining, and altering from the intermediate to the open state involves pumping abrasive material through the inset until it is eroded away. Then, the harder lining provides a full radial opening. The abrasive material can be a slurry containing material otherwise used for hydraulic fracturing. Finally, the valve system may comprise one or more additional valves to shut down fluid flow from a group of valves when the concentration of hydrocarbons in the formation fluid flowing from the group falls below a predetermined level.

BRIEF DESCRIPTION OF THE DRAWINGS

The invention will be fully explained in the following detailed description with reference to the accompanying drawings in which similar numbers references similar or equivalent parts, and in which.

DETAILED DESCRIPTION OF THE PREFERRED EMBODIMENTS

Figure 1:
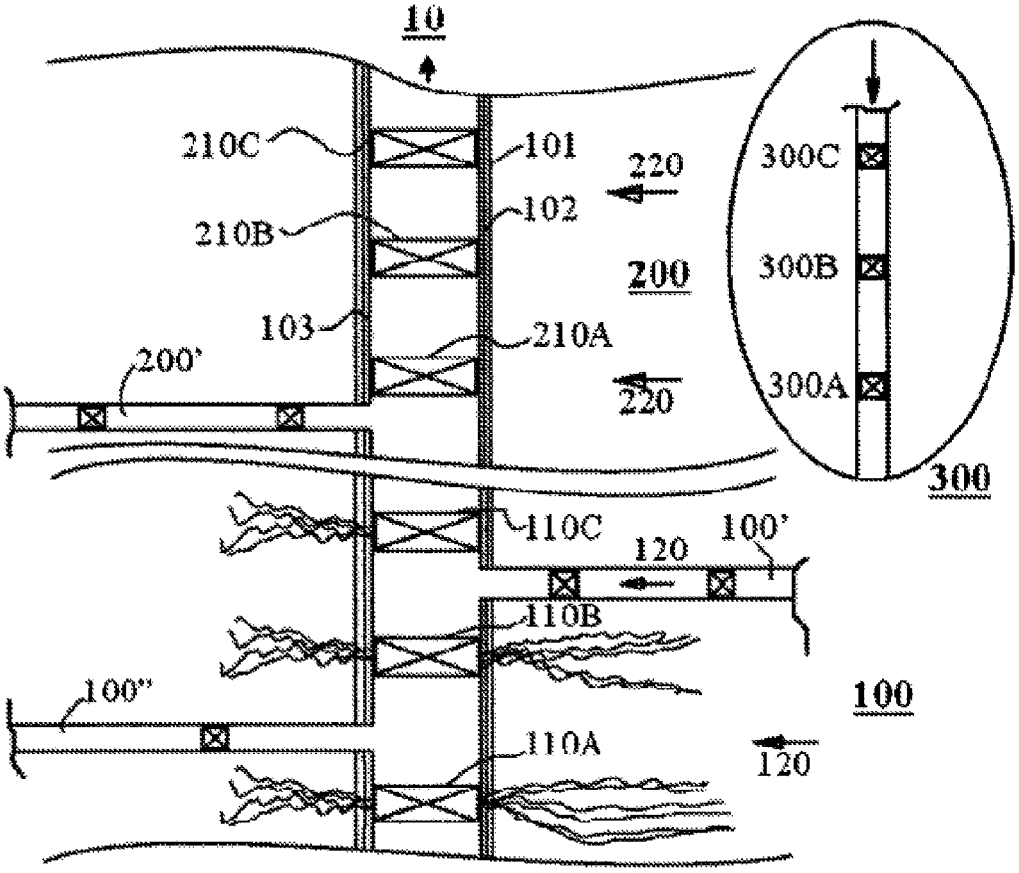
FIG. 1 is a schematic view of a well comprising several zones and branches.

FIG. 1 is a schematic cross sectional view of a well system used in production of hydrocarbons, i.e. oil and/or gas, from a subterranean reservoir. A hole or wellbore 101 is drilled through several layers of rock in the formation. In FIG. 1, two production layers 100 and 200 are shown. The wellbore is lined with a steel casing 102, which is cemented to the formation. In FIG. 1, the production layers 100 and 200 contain hydrocarbons, and they are separated by rock layers that do not contain hydrocarbons. The casing 102 may be penetrated at depths corresponding to the productive layers 100 and 200, and hydraulic fracturing may be used to create and open cracks in the formation to facilitate fluid flow from the formation into the production well. Horizontal wells 100', 100" and 200' may branch out from a vertical production well, and extend several kilometers through a production layer 100, 200 containing hydrocarbons.

A production pipe 103 is provided within the casing 102, and the completed well can be divided into several production zones by using packers (not shown) to seal off the annular space formed by the outer surface of production pipe 103 and the inner surface of casing 102. The valves 110A-C, 210A-C, . . . shown in FIG. 1 are disposed with predetermined distance(s) along the axial length of the production pipe 103 and control fluid flow from a formation 100, 200 into the segment of production pipe corresponding to the production zone. The valves can generally be of different design or types, e.g. sliding sleeve valves, butterfly valves and ball valves of different sizes and designs, and used for different purposes as known in the art. In operation, fluid flowing from several zones (shown by arrows 120) at different rates can be mixed and conveyed up the production pipe to the surface 10.

In order to increase the amount and/or rate at which hydrocarbons are produced from a zone, one or more injection wells 300 may be provided at a certain distance from the production well. An injection well injects fluid into one or more zones, e.g. to increase the pressure in the reservoir or to provide some chemical composition(s), and can be made in a similar manner as the production well. A typical oil or gas field can comprise one or more production wells and zero or more injection wells.

As discussed above, various devices, like sliding sleeve valves, butterfly valves and ball valves of different sizes and designs, can be used to control fluid flow and for other purposes. For convenience, the term "ball operated device" is intended to include these and other devices when hydraulically operated using a drop ball, dart or similar device. All such ball operated devices comprises a seat on which the ball, dart or similar device can land. The ball seat can be a cage- or tubular- or circular-shaped element displaced within a valve arrangement or sleeve and with a ring-shaped lug having a diameter less than the diameter of the ball, dart or similar device that is to land thereon. Obviously, drop balls of different sizes may be provided as in a conventional drop ball system. The difference is that a drop ball will pass groups of seats having similar sizes until it operates a group of valves rather than just one single device passed and operated on by conventional drop ball systems.

Figure 2A:
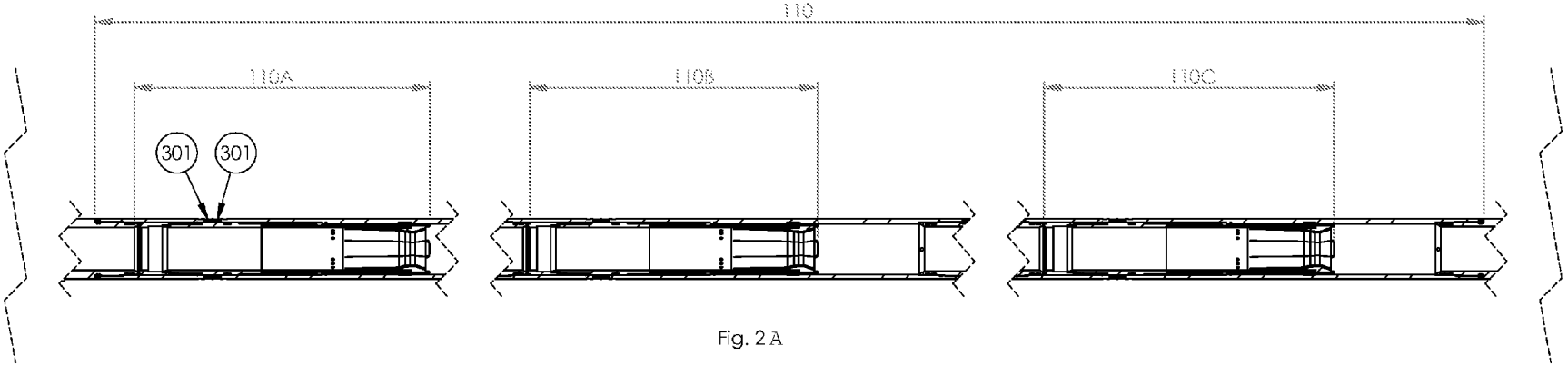
FIG. 2A-2B show schematic views of a valve system according to one embodiment of the invention.
Figure 2B:
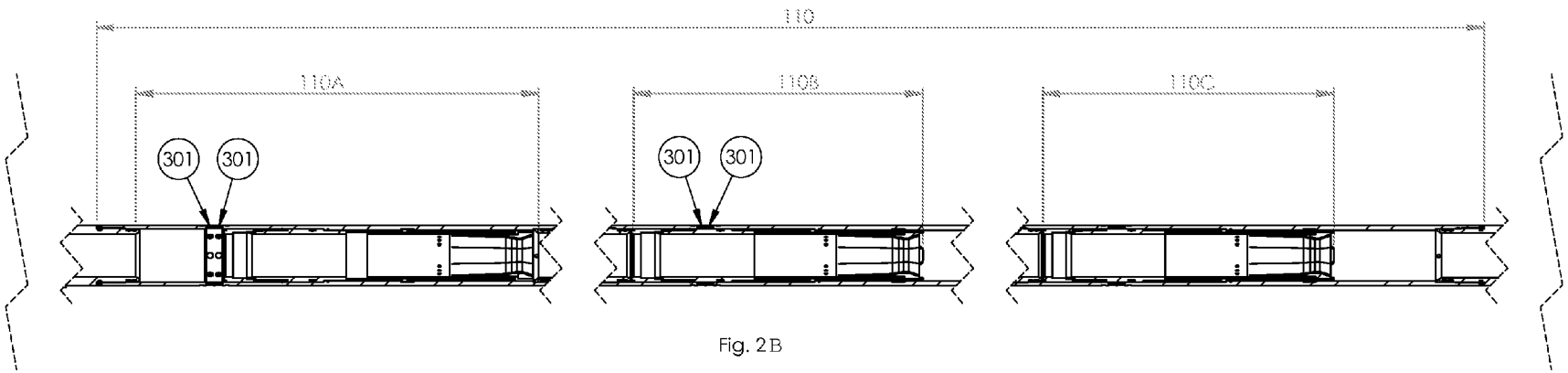
Figure 3:
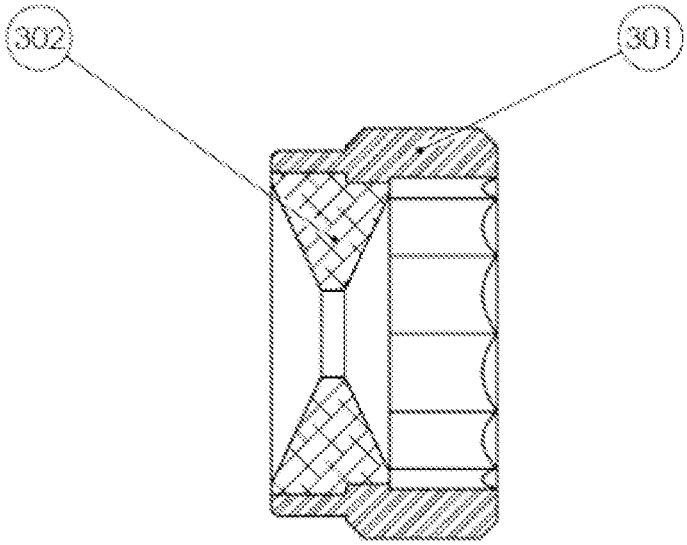
FIG. 3 is a schematic view of a nozzle for use in a drop ball activated valve according to one embodiment of the invention.

FIG. 2A-2B show a tubular 110 which can be a part of the production pipe 103 and with at least one group of at least two valves 110A-C, all of which are disposed within the tubular along the axial length thereof and with predetermined distance(s) from each other and can be provided with an expandable ball seat, for example as disclosed in U.S. patent application Ser. No. 12/705,428 being herein incorporated by reference in its entirety, and thus can be opened one after the other using one and only one drop ball. The valve 110A is closest to the surface, and hence opened first by e.g. the drop ball. In FIG. 2A the valve 110A is shown in a closed position, while in FIG. 2B the valve 110A is shown in an open position. Each valve 110A-110C can comprise means for providing for the three states of the valve or at least one radial opening therein. Once the valve 110A is being opened (i.e. the radial openings or ports of the valve are being opened), e.g. by means of the drop ball (not shown), at least one valve nozzle 301 therein is providing for an intermediate state of the respective radial opening having an intermediate radial opening for at least some time that is required to open all the remaining valves 110B-110C in the valve group, and providing thereafter for an open state of the respective radial opening having a full radial opening larger than the intermediate radial opening. According to one embodiment an inset 302 in the valve nozzle 301 (shown in FIG. 3), which can be made of e.g. tungsten carbide (WC) and is being arranged within at least one of the radial openings in the cylindrical valve wall, provides a small radial hole from the interior of tubular 110 to the surrounding formation. The radial openings, that can comprise nozzles 301, can be circumferentially disposed in the valve (e.g. its tubular wall or sleeve) with any suitable or appropriate predetermined pattern and not only with the pattern shown in the drawings. The inset 302 can be made of e.g. steel and can also have a greater thickness at the outer circumference or periphery than the thickness at the portion or area creating the small hole for the intermediate state (FIG. 3). Since the hole is small, it limits the amount of fluid flowing through it, and hence causes a relatively small pressure drop in the central bore of the tubular. A minor pressure drop may easily be compensated, so that the hydraulic pressure remains sufficiently large to open valve 110B, which is however shown only in a closed position in both FIGS. 2A and 2B. Valve 110B can comprise at least one nozzle 301 having an inset 302 being the same as or similar to the one in valve 110A, thus creating a new, small pressure drop. These pressure drops are made sufficiently small that they can be compensated in a relatively simple manner. According to one embodiment of the invention said altering means for providing for the three states of the valve or at least one radial opening therein, can be associated with the ball seat arrangement operable by the drop ball or the like which provides for going from closed state to intermediate open state, and the nozzle 301 with the inset 302 which provides for going from intermediate open state to full open state. According to another embodiment of the invention said altering means can be associated with an inset 302 being a concentric ring (e.g. 301 in FIG. 2B) (with corresponding merging or overlapping intermediate holes) having an outer circumference firmly engaging the inner surface of the valve cylinder and covering all or at least some of the radial openings associated with said valve, thus providing for going from intermediate open state to full open state of said valve. In this case there can be arranged a recess in the inner area or surface or wall of the valve associated with the radial opening(s) for the further accommodation of the inset for further providing for the firmly engagement and for not allowing the ring-shaped inset to slide along the axis of the tubular or the valve. The intermediate holes or openings of the inset can be overlapping or merging with the radial openings. All this means that the inset can be placed within/into (e.g. in form of a kind of a nozzle) or covering onto (e.g. in form of a concentric ring or cylinder) the associated radial opening(s) associated with said valve and/or its wall or sleeve. It is also important to note that the material providing for the full radial opening (e.g. of the nozzle or the lined radial opening) should be harder than the material providing for the intermediate opening (e.g. of the inset). Preferably these materials should not be limited only to tungsten carbide (WC) and steel respectively.

When all the valves are opened, an abrasive material is passed through the opening. The abrasive material can e.g. be a slurry with about 5% ceramic balls or sand, such as the medium used for hydraulic fracturing. In this case the slurry flows comparatively slowly in the central bore. When it reaches a hole, the speed increases. Hence the abrasion is much larger at the radial ports or openings or nozzles than in the central bore. In a preferred setup, the ports can be lined with a hard material, e.g. tungsten carbide (WC), but not limited only thereto, providing the final openings. Ordinary steel can be set within the hard inner surface. For example, the hard liner can be a cylinder, and the erodible steel inset can be shaped as a concentric ring having an outer circumference engaging the inner hard surface of the hard liner. Tests have shown that normal grade steel is removed from the liner within 1-2 hours using material(s) otherwise used for hydraulic fracturing thus providing for the full open state of the radial openings.

It is noted that other suitable or appropriate softer material may be provided within the liners. Furthermore, the liners need not be cylindrical and the insets do not need to be annular, but they can be elliptical or rectangular or have another suitable or appropriate shape or form.

The invention claimed is:

1. A valve system for providing fluid flow through radial openings disposed along an axial length of a tubular, the valve system comprising at least one valve group, the at least one valve group comprising at least two valves disposed along an axial length of the tubular a predetermined distance from each other, wherein each valve comprises means for providing a closed state of the valve, an intermediate state of the valve providing an intermediate opening for at least a time required to open all remaining valves in the group, and an open state of the valve providing a full radial opening larger than the intermediate opening, wherein the intermediate opening is provided by an inset fit onto or into the full radial opening and the full radial opening is lined with a material that is harder than a material of the inset, wherein the inset tapers inwardly from two sides to form the intermediate opening, the inset being thicker at an outer circumference than proximate the intermediate opening and having a liner that surrounds the inset along its entire outer length.

2. The valve system of claim 1, wherein at least one valve group is operable by at least one drop ball.

3. The valve system of claim 2, wherein each valve in said at least one valve group comprises an expandable ball seat having a seat diameter adapted to the drop ball.

4. The valve system according to claim 1, further comprising at least one valve being operable to close fluid flow through the tubular.

5. The valve system of claim 1, wherein the material lining the full radial opening is tungsten carbide and the inset is formed of steel.

6. The valve system of claim 1, wherein the inset is ring-shaped.

7. The valve system of claim 6, wherein the ring-shaped inset has an outer circumference that is engaged with an inner surface of the valve.

8. The valve system of claim 7, wherein the ring-shaped inset is at least partially disposed in a recess formed in the inner surface of the valve.

9. The valve system of claim 6, wherein the full radial opening comprises a ring-shaped liner that surrounds the ring-shaped inset.

10. The valve system of claim 9, wherein the ring-shaped inset includes an annular shoulder that seats against an annular shelf formed in the ring-shaped liner.

11. A method for providing fluid flow through radial openings disposed along an axial length of a tubular, the method comprising:

disposing at least one valve group associated with a section of the tubular, the at least one valve group comprising at least two valves disposed along an axial length of the tubular a predetermined distance from each other, each valve comprising means for providing a closed state of the valve, an intermediate state of the valve providing an intermediate opening for at least a time required to open all remaining valves in the group, and an open state of the valve providing a full radial opening larger than the intermediate opening, wherein the intermediate opening is provided by an inset fit onto or into the full radial opening and the full radial opening is lined with a material that is harder than a material of the inset, the inset tapering inwardly from two sides to form the intermediate opening, the inset being thicker at an outer circumference than proximate the intermediate opening and having a liner that surrounds the inset along its entire outer length, altering the state of each valve from the closed state to the intermediate state in turn, and altering the state of each valve from the intermediate state to the open state by pumping an abrasive material through the openings.

12. The method of claim 11, wherein comprising using at least one drop ball to alter the valves in the valve group from their closed states to their intermediate states.

13. The method of claim 11, further comprising:

monitoring fluid flowing through each valve section, and closing a section of the tubular associated with a valve section when fluid flowing through the associated valve section no longer satisfies at least one predetermined criterion.

14. The method of claim 11, wherein the material lining the full radial opening is tungsten carbide and the inset is formed of steel.

* * * * *

UNITED STATES PATENT AND TRADEMARK OFFICE

CERTIFICATE OF CORRECTION

PATENT NO. : 8,978,765 B2
APPLICATION NO. : 13/316317
DATED : March 17, 2015
INVENTOR(S) : Kristoffer Braekke et al.

It is certified that error appears in the above-identified patent and that said Letters Patent is hereby corrected as shown below:

On the Title Page:

At Item (30), line 2, insert -- Dec. 9, 2011 (NO).....20111679 --.

Signed and Sealed this
Twenty-second Day of December, 2015

Michelle K. Lee

Michelle K. Lee
*Director of the United States Patent and Trademark Office*